US007752878B2

(12) United States Patent
Schmeink

(10) Patent No.: US 7,752,878 B2
(45) Date of Patent: Jul. 13, 2010

(54) SERVO-PRESS WITH ENERGY MANAGEMENT

(75) Inventor: Martin Schmeink, Salach (DE)

(73) Assignee: Schuler Pressen GmbH & Co. KG, Göppingen (DE)

( * ) Notice: Subject to any disclaimer, the term of this patent is extended or adjusted under 35 U.S.C. 154(b) by 398 days.

(21) Appl. No.: 11/879,559

(22) Filed: Jul. 18, 2007

(65) Prior Publication Data

US 2008/0016940 A1 Jan. 24, 2008

(30) Foreign Application Priority Data

Jul. 20, 2006 (DE) ..... 10 2006 033 562

(51) Int. Cl.
*B21C 51/00* (2006.01)

(52) U.S. Cl. ..... 72/29.2; 72/437; 72/445; 72/452.5

(58) Field of Classification Search ..... 72/28.1, 72/29.2, 436, 437, 445, 452.5, 405.01, 405.09, 72/405.11; 100/346; 307/62; 310/74; 700/295–298
See application file for complete search history.

(56) References Cited

U.S. PATENT DOCUMENTS 5,913,932 A * 6/1999 Takayama ..... 72/405.09
6,742,457 B2 * 6/2004 Shiroza ..... 101/485
7,102,316 B2 9/2006 Beyer

FOREIGN PATENT DOCUMENTS

| | | |
|---|---|---|
| DE | 198 21 159 A1 | 11/1999 |
| DE | 10 2005 026 A1 | 1/2006 |
| WO | WO 93/20613 | 10/1993 |

* cited by examiner

*Primary Examiner*—Dana Ross
*Assistant Examiner*—Matthew G Katcoff
(74) *Attorney, Agent, or Firm*—R. S. Lombard; K. Bach

(57) ABSTRACT

In a press installation including a number of presses with servo-drives for operating the presses and auxiliary equipment such as workpiece handling devices wherein an energy management system is provided including a DC voltage intermediate circuit connected to a power supply grid via an AC/DC converter and to the servo-drives via servo-converters, a fly-wheel storage device is connected to the intermediate circuit for supplying energy thereto and recapturing energy therefrom under the control of a control arrangement which controls the flow of power between the intermediate circuit, the servo-drives, the fly-wheel storage device and the power supply grid.

26 Claims, 2 Drawing Sheets

SERVO-PRESS WITH ENERGY MANAGEMENT

CROSS-REFERENCE TO RELATED APPLICATION

This application claims the priority benefits of German Application No. 10 2006 033 562.7 filed Jul. 20, 2006.

BACKGROUND OF THE INVENTION

This invention resides in a press installation and in a method of operating such an installation. The invention relates particularly to large part-press installations, for example, in the form of press-lines are on multistage large part presses in the form of transfer presses.

Conventional presses include a mechanical press drive with an electric drive motor and a fly-wheel which serves as an energy storage device. A crank drive, a circular drive, an elbow drive or a similar drive converts the rotation of the fly-wheel into a back and forth movement of a plunger. The fly-wheel is so large dimensioned that its speed changes remains tolerable. As a result, it stores substantially more energy than is necessary for a single deformation procedure. At least, if the fly-wheel is firmly connected to the circular drive a correspondingly large amount of energy needs to be destroyed when the press is stopped.

Lately, more and more considerations are given to servo-presses which include servo-motors for driving the plunger and also auxiliary equipment. These servo-motors drive the plunger on the respective other equipment of the press without the use of a fly-wheel. Consequently, the respective servo-motor must provide the power peaks required by the plunger or other equipment.

German publication DE 10 2005 026 818 A1, for example, discloses a press with a drawing die which is provided with electric drives. The electric drives are connected to the drives for the main movement of the plunger and/or the auxiliary movements of workpiece transport elements by way of an, at least sequentially usable guide shaft and, on the other hand, by way of energy storage devices and/or energy exchange modules.

The connection between the main drives and the auxiliary drives and the drawing dies by way of guide shafts and energy exchange modules however is quite expensive.

Furthermore, German publication, DE 198 21 159 A discloses a deep-draw press whose plunger is driven by servo-motors via spindles. The drawing die is also driven by servo-motors via spindles. The servo-motors of the drawing die are also interconnected by electrical shafts. Both servo-motors are controllable by a program computer.

Servo-motor controlled machines cause varying loads on the power supply grid. This may cause excessive loads on the power supply grids. This may cause a problem occasionally already with a single machine, but is very problematic if several machines working in parallel are at peak loads all at the same time. In spite of efficient drive techniques, this may lead to energy losses which need to be avoided.

It is the object of the present invention to provide an improved servo-press installation which avoids excessive power supply peak requirements.

SUMMARY OF THE INVENTION

In a press installation including a number of presses with servo-drives for operating the presses and auxiliary equipment, such as workpiece handling devices wherein an energy management system is provided including a DC voltage intermediate circuit connected to a power supply grid via an AC/DC converter and to the servo-drives via servo-converters. A fly-wheel storage device is connected to the intermediate circuit for supplying energy thereto and recapturing energy therefrom under the control of a control arrangement which controls the flow of power between the intermediate circuit, the servo-drives, the fly-wheel storage device and the power supply grid.

The press installation according to the invention provides an intermediate DC power supply circuit connected to the power supply grid, or network, by way of a controlled power converter. This intermediate DC power supply circuit supplies power to all servo-drives for the plungers and all the servo-drives of the auxiliary equipment such as part transport arrangements or intermediate storage devices, drawing dies, etc. The respective servo-drives are all supplied with power from the same intermediate DC power supply circuit preferably via DC/AC converter devices. The intermediate DC power supply circuit also includes a fly-wheel storage device which is capable of taking energy from the intermediate DC power supply circuit and also to return energy to the intermediate DC power supply circuit. A supervisory control arrangement controls the operation of the power converter devices. In this way, the variations of the power withdrawn from the electrical power supply grid can be minimized and the overall-power requirements for the whole press installation remain essentially constant. This substantially reduces the resistance losses in the power supply lines which increase with the square of the current flow. In addition to a reduction in losses, the power supply grid quality is increased since load-induced voltage variations in the power supply are minimized. Furthermore, expenses for the power supply connections are substantially reduced since they do not need to be de-energized for the peak power requirements of the presses, but only for the average power requirements. With the intermediate DC voltage power supply circuit and the DC/AC converters disposed between the press drives and fly-wheel, the servo-motors of the press drives and the fly-wheel can be operated independently at different speeds. The converters practically form an electrical infinitely variable transmission.

The control arrangement controls the power converter arrangement, also called power supply unit, and determines whether it supplies power to this intermediate DC power supply circuit, also called the DC bus or returns energy therefrom. Predetermined current flow limits are observed in the process. The current limits may be determined dynamically. The control arrangement may furthermore supervise the speed of the fly-wheel storage device and the intermediate circuit voltage. It may control the supply and return of energy from the power supply grid to the DC lines and back based on the following values:

upper limit of the power storage fly-wheel speed;
lower limit of the power storage fly-wheel speed;
desired value of the fly-wheel speed;
actual fly-wheel speed;
desired value of the intermediate circuit voltage;
actual value of the intermediate circuit voltage.

The control is performed preferably with the aim of minimizing power supply load peaks, that is, to establish a uniform power supply load. For activating the fly-wheel storage device, the dropping and raising of the intermediate circuit voltage can be measured as this is the result of differences between the energy consumption and energy supply from the grid. If limits are provided for the withdrawal of energy from the grid and for the return of energy into the grid with load peaks or return peaks differential amounts remain, which must be taken from the fly-wheel storage device or returned to it.

If the immediate circuit voltage drops, the slow-down process for the fly-wheel storage is initiated, that is energy is taken from the fly-wheel storage until the intermediate circuit voltage has reached the original value. If the intermediate circuit voltage rises, energy is supplied from the intermediate circuit to the fly-wheel storage which is accelerated thereby. The fly-wheel is accelerated until the intermediate circuit voltage has dropped to the original, that is, the desired value.

With the dynamic variability of the current limits for the supply of energy from, and the return of energy to, the grid, the supply-and-return energy flow can be controlled. The current limits for the supply and return of energy are separate parameters and are controllable dynamically from without. By changing the current limit of the supply unit the point at which the energy supply is supplemented by the fly-wheel storage can be varied. By changing the return current limit of the power supply unit, the point at which energy is absorbed by the fly-wheel storage can be varied.

With regard to the fly-wheel speed, the following operation is possible: After switching on the servo-press, first the fly-wheel of the fly-wheel storage device is accelerated to the desired speed which is about ⅔ of maximum speed. At ⅔ of maximum speed the fly-wheel storage device is ready for supplying energy with a reduction of the speed and also for taking up energy by acceleration of the fly-wheel from ⅔ of maximum speed to maximum speed. In order to achieve a uniform grid power supply load or possible, the current limits are reduced to such an extent that the power peaks are provided for as much as possible by the fly-wheel storage unit. In this way, the speed change reaches maximum. The fly-wheel speed changes between maximum speed and a minimum speed of almost zero.

The energy profile, that is, energy need depending on time of a servo-press depends on:

the deformation work;

the movement profile;

the number of cycles per minute.

Therefore, an optimum determination of the current limits for the manufacture of a part is possibly not optimal for the manufacture of another part. As a solution, the current limits of the power supply unit can be determined iteratively starting and from a base setting. The current limits are initially reduced to such an extent and for such a period until the fly-wheel storage device reaches during operation the upper and the lower limit speeds. In this regard, it can also be supervised whether the fly-wheel reaches the desired speed within a press cycle.

The data determined for a particular part, that is, workpiece, particularly the current limits for the energization of the DC busses from the grid and for the return of energy from the DC bus to the grid can be recorded specifically for each workpiece data stage device. Later this data is available, so that it does not have to be re-determined.

Instead of current limits, that is, =limit value for the current, also power limits, that is—limit values for the power that can be used, wherein the above description applies correspondingly. There is an advantage in using power limits because of the independence of the validity of the stored limit values for the initially possibly non-constant grid voltage.

With the limitation of the current as power supply to the converter arrangement and the current or power limitation for the return to the grid, for the converter arrangement building components designed for certain normal currents and peak currents can be used which are substantially lower than the peak currents needed by the press installation. As a result, the converter arrangement may be smaller and the costs therefore are reduced.

The fly-wheel storage device is, with respect to the storage capacity, so dimensioned that a predetermined partial amount of its maximum capacity is sufficient to buffer all load changes occurring in the press installation. The difference between this partial amount and the maximum capacity of the fly-wheel storage device corresponds to the maximum brake energy to be taken up by the fly-wheel storage device driving an emergency shut down of the press installation. In this way, it is made sure, on one hand, that the fly-wheel storage device can be used for providing for a totally uniform power supply grid loading whereas, on the other hand, all drives of the press installation can be shut down in a controlled, synchronous manner. After an emergency shut-down of the press, the fly-wheel storage device runs at maximum speed. There is no need to return power to the power supply grid.

Alternatively, the fly-wheel storage device may be dimensioned somewhat smaller, so that during an emergency stop it can accept at least a large part of the brake energy released by the press installation during an emergency shut down while the system is changed from grid loading to supplying power to the grid in a controlled manner.

The control arrangement may be such that the power used at the servo-drive arrangements is recorded. This can be done, for example, by measuring the voltages and currents over time as provided to the servo-motors. Additionally or alternatively, power measuring devices may be provided at the converter arrangements. If, for example, the DC currents entering the converter arrangements and the respective voltages are measured, the effective power can be determined herefrom in a simple and safe manner.

On one hand the control arrangement can integrate the momentary power applied during a press cycle at each converter arrangement or, respectively, each servo-motor, and, therefore determine the energy consumed or fed back by the respective drive. The sum of the energy amounts measured or calculated for the individual drives represents the amount of energy that needs to be withdrawn from the grid during a press cycle. If this energy amount is divided by the duration of a press cycle, the energy input to the intermediate DC voltage circuit for which the converter arrangement should be adjusted is obtained which also represents the grid load. Under the press cycle, in this regard, a complete upward and downward stroke of the plunger, that is, one operating cycle of the press is to be understood. The beginning and the end of such a press cycle does not need to be counted from a plunger dead-end, but they can be selected in any way. For a multi-stage press beginning and end points for a working cycle are all the same for all the elements, that is for all elements and all the servo-drive arrangements of the press installation.

While the control arrangement consequently controls on one hand the converter arrangement depending on the energy requirements needed for one press cycle, it can control on the other hand, the fly-wheel energy storage depending on the momentary power output of the individual servo-drive devices. If the converter arrangement is controlled based on the energy balance, the fly-wheel energy storage device is controlled based on the power balance. The fly-wheel energy storage device compensates at any time for the difference between the actual power consumption of the press and the power withdrawn from the grid.

The control arrangement may additionally monitor the voltage of the intermediate DC voltage circuit. This voltage does not necessarily have to be kept constant. It is, however, expedient to maintain that voltage within reasonable limits so as to avoid excessive voltages on one hand and, on the other, to prevent a voltage drop to values insufficient for the operation of the converter.

When determining the control strategy for all the converters, preferably, first all servo-drives receive control signals without consideration of possible load peaks. Possibly occurring load peaks are accommodated by the fly-wheel storage device. Consequently, the operator is free to set the number of press strokes, the deforming forces, the accelerations, etc. in an expedient manner. He can utilize the capacity of all the drives to the maximum without taking into consideration the power needs for the whole press installation.

The invention will become more readily apparent from the following description thereof on the basis of the accompanying drawings.

DESCRIPTION OF THE PREFERRED EMBODIMENTS

Figure 1:
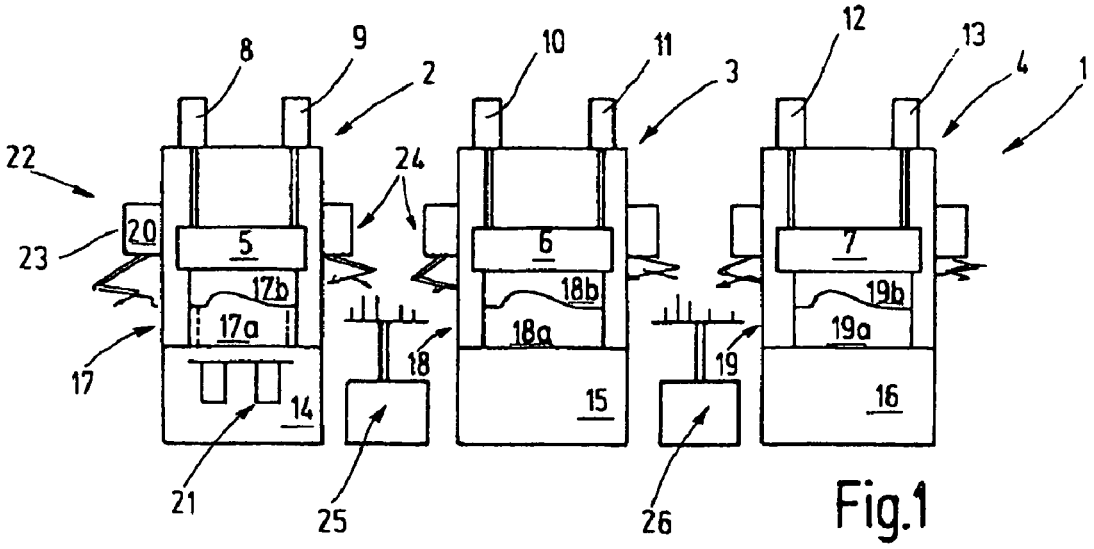
FIG. 1 shows a press installation with servo-drives for the plungers and auxiliary equipment in a schematic representation.

FIG. 1 shows a press installation 1 including at least one, but in the shown example several, individual presses 2, 3, 4. The presses are provided for a stepwise deforming of a workpiece, for example, a metal sheet such as a vehicle body part, or similar, which is treated in one press after another. The press 2 is a drawing press, whereas, the presses 3 and 4 are follow-up presses. Each press 2, 3, 4 has a plunger 5, 6, 7. For driving the plunger 5 at least one, but preferably several servo-motors 8, 9 are provided. Likewise, the plungers 6, 7 are driven by servo-motors 10, 11, 12, 13. The servo-motors 8 to 13 drive the plunger 5, 6, 7 by means of a suitable drive such as a spindle drive. Also other drives may be used such as linear motors or similar drives. Below the plunger 5 to 7 there is in each case a press table 14, 15, 16. For deforming the workpiece, tools 17, 18, 19 are used, each including a ball arm part 17*a*, 18*a*, 19*a* disposed on a press table 14, 15, 16. The respective upper tool part 17*b*, 18*b*, 19*b* is mounted to the respective plunger 5, 6, 7. The tool 17 is a drawing tool. The ball arm part 17*a* works together with a drawing die which uses one or more servo-drives 20, 21.

In order to provide for a workpiece transfer, workpiece transfer arrangement 22 is provided and which may include one or more feeders 23 and handling units 24. The handling units 24 are provided with several grippers for moving metal sheets onto the tools 17, 18, 19, and again out of these tools. Between the presses 2, 3 and 3, 4 intermediate storage devices 25, 26 may be provided in order to move the metal sheets into the tools 17, 18, 19 and remove them from the tools. Also these interim storage devices are devices which may include servo-drives.

Figure 2:
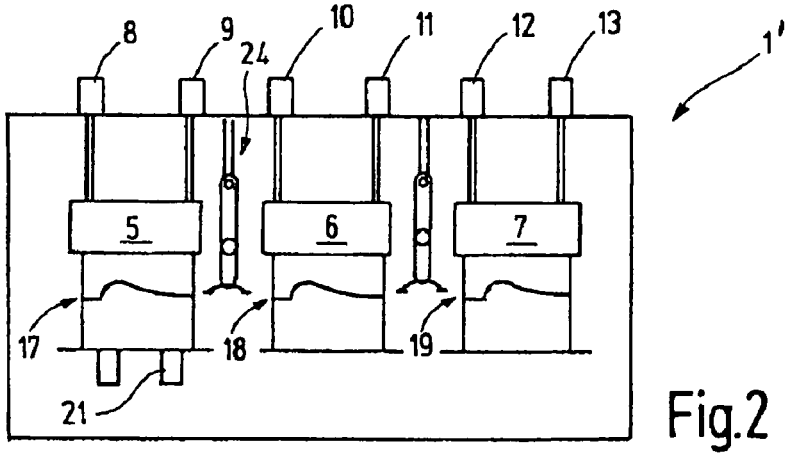
FIG. 2 shows a press installation in the form of transfer presses with several servo-motor operated press stages and servo-motor operated auxiliary equipment.

FIG. 2 shows a press installation 1' in the form of a transfer press. This press installation 1' is different in as much as it does not exhibit the separate press frames of the presses 2, 3, 4, but the presses are combined to have a common transfer press rack, that is they have a common frame. The arrangement includes one or several plungers 5, 6, 7. The description above also applies to the embodiment of the press installation 1' according to FIG. 2, wherein however, the interim storage structures 25, 26 may be omitted.

Figure 3:
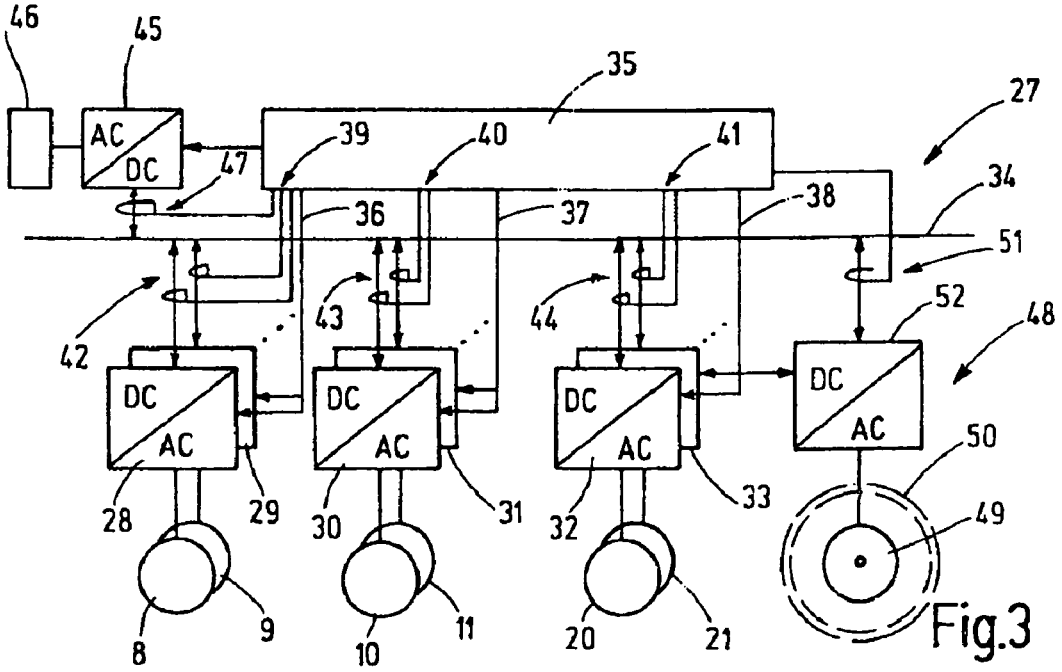
FIG. 3 shows electric power supply arrangement for the presses of FIG. 1 or 2.

FIG. 3 shows schematically the electrical drive system 27 of the press installation 1 for energy management. The drive system includes all the electric servo-motors covered by the energy management concept. In FIG. 3 are, as an example, the servo-motors 8, 9, 10, 11 of the presses 2 and 3 for driving the plungers 5, 6 and the servo-drives 20, 21 of the drawing dies shown. Energy is supplied to these servo-motors 8 to 11 and 20, 21 via converter units 28, 29, 30, 31, 32, 33 from a common DC voltage intermediate circuit 34. The converter units 28 to 33 convert the DC voltage to an alternating voltage of desired frequency and current for driving the servo-motors 8, 9, 10, 11, 20, 21. A control unit 35 is provided which controls the individual converter units 28 to 33. It includes corresponding control outputs 36, 37, 38. It also has control inputs 39, 40, 41 provided with equipment 42, 43, 44 for determining or sensing the power consumption in the servo-motors 8, 9, 10, 11, 20, 21. The equipment 42, 43, 44 may, for example, be means capable of sensing the current supplied by the DC voltage intermediate circuit 34 to the converters 28 to 33. Power is supplied at a given voltage to the DC voltage intermediate circuit in the most simple case may be by an uncontrolled converter, preferably, however, by a controlled converter, from a supply grid 46. A power monitoring device 47 may be used to generate a signal representative of the power delivered from the converter 45 to the DC voltage intermediate circuit 34, which signal is supplied to the control unit 35.

The drive system 27 further comprises a fly-wheel storage unit 48, including a motor 49 and a fly-wheel 50. The power supplied to the fly-wheel storage unit 48 and the power supplied thereby can be monitored by a power monitoring device 51 in the connecting line between the DC voltage intermediate circuit 34 and a converter 52 and the information can be supplied via a control line to the control unit 35.

While in FIG. 3 several selected servo-motors together with the respective converters are shown, it is to be understood that the drive system 27 may include all the servo-motors, to which power is supplied from the DC voltage intermediate circuit.

Figure 5:
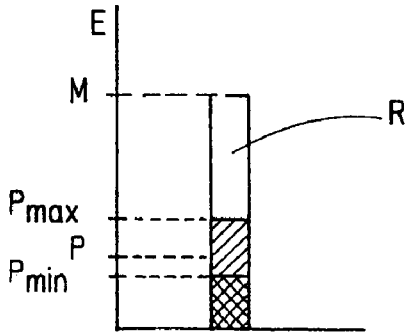

The press installation 1 and 1' and the drive system 27 operate as follows:

For the operation of the press installation 1, first the curves or schedules of movement of the individual servo-motors 8, 9, 10, 11, 20, 21 based on a central press operating schedule are determined, for example, by recording them in the form of a data set or manual programming. The press installation is then placed into operation by activating the converter 45 and supplying DC voltage to the DC voltage intermediate circuit 34. Via the converter 52, the fly-wheel storage device 48 is charged with a buffer energy that is an amount of energy which is required to buffer the load peaks occurring in the servo-motors 8, 9, 10, 11, 20, 21. The buffer energy P is shown in FIG. 5 as part of a maximum storage energy M which can be stored by the fly-wheel storage device 48. It is not greater than a maximum buffer value $P_{max}$. This value is so selected that a press installation 1 can be braked down in an emergency and the remaining difference between maximum energy M and maximum buffer energy $P_{max}$ is sufficient to accommodate the energy released during braking.

Figure 4:
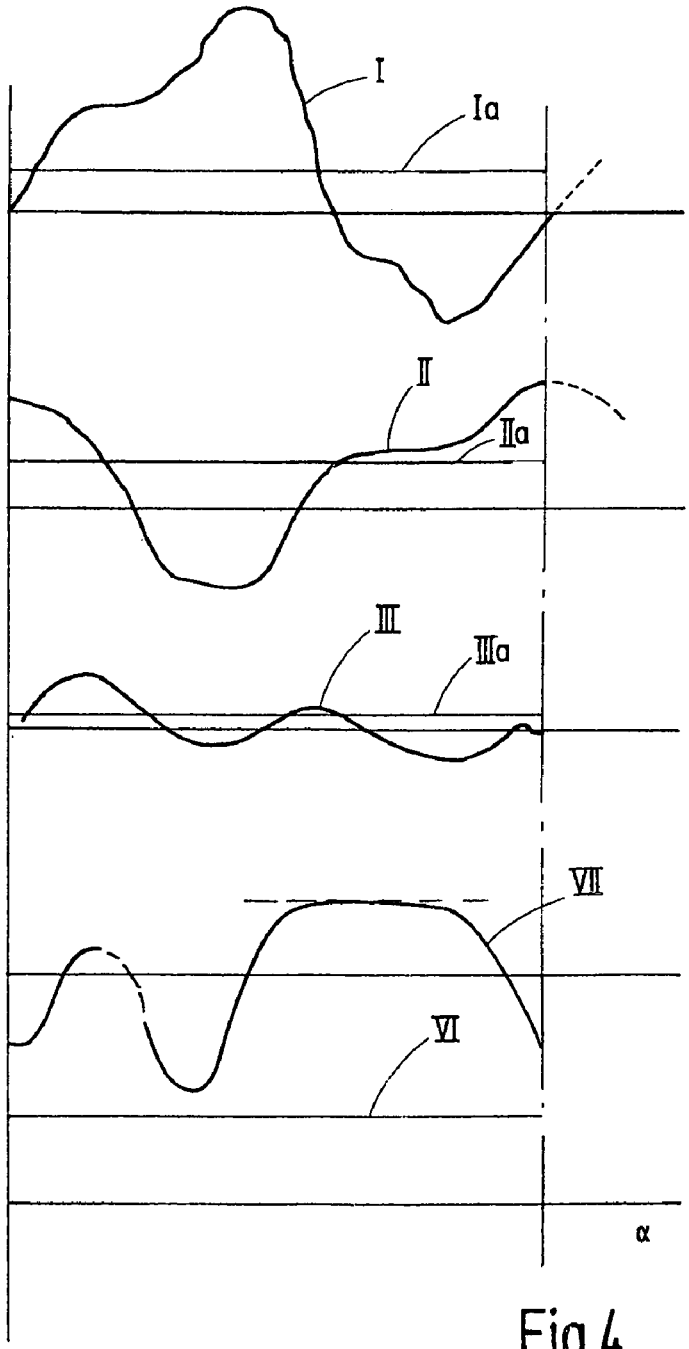
FIG. 4 shows various diagrams representing the power requirement of the various servo-drives and the fly-wheel storage device; and, FIG. 5 shows a diagram for the dimensioning of the capacity of the fly-wheel storage device.

Then the individual converters 28, 29, 30, 31, 32, 33 are so controlled that the servo-motors 8, 9, 10, 11, 20, 21 perform the desired movements. FIG. 4 shows the power supplied to, or released by, the servo-motors 8, 9 plotted over the press angle α which corresponds to a central press operating schedule step of 360 degrees of the press angle α which corresponds to the revolution of an eccentric shaft of a conventional press and, consequently, in connection with the press installation of FIGS. 1 an 2, a full power stroke and return stroke of the respective plunger 5, 6, 7.

As apparent, the power uptake or release of the plunger drive has in accordance with curve I a clear maximum which occurs, for example, during the metal sheet deformation. Furthermore, there may be a negative part which indicates energy back-feeding. The servo-drives of the individual presses 2, 3, 4 may have different power uptake curves and operate with phase displacement relative to one another.

Another diagram shows a curve II which represents the power uptake and release of the servo-motor 21 of the drawing die. A clear back-feeding section is, for example, present specifically in the area where the servo-motor of the plunger requires a substantial power input.

Another curve III characterizes in an exemplary manner, the power uptake of other equipment such as the intermediate storage devices 25, 26 or the part transport arrangement 22.

The control arrangement 35 may be, for example, so designed that it integrates the power uptake according to curves 1, II and III and consequently determines the average power uptake required. This integral amount is shown in FIG. 4 for each curve I, II, III separately, that is, curves Ia Ia, IIIa. The overall integral, that is the sum of the curves Ia, Ia, IIIa represents the electrical energy uptake of the press installation 1 for a press cycle which, based on the press angle α can be considered a constant power supply VI, which is supplied by the power grid. In order to provide for such a constant power supply requirement, the fly-wheel storage device 48, buffers in each press cycle the power uptake and back feeding in accordance with curve VII. In other words, the converter 52 is so controlled that, at any point in time, the power supplied by the DC voltage intermediate circuit 34 corresponds to the overall energy uptake, driving a press cycle divided by the time-duration of a press cycle.

As apparent, the fly-wheel storage device 48 is exposed to phases of energy uptake and phases of energy back feeding. Its state of change is monitored by the control unit 35. It ensures that the fly-wheel of the storage device 48 operates at the beginning and the end of each press cycle with the same speed so that, over time, it is neither charged nor discharged. Furthermore, it ensures that the storage content does not exceed a value $P_{max}$ at any time so that a power uptake capacity R, see FIG. 5, is always available in order to store all of the braking energy released during an emergency shut down of the whole press installation 1. In addition, the energy management by the control unit 35 is preferably so operated that the energy content of the fly-wheel storage device 48 drops during a press cycle never below a minimum value $P_{min}$. The minimum value $P_{min}$ is so determined that the energy stored in the fly-wheel storage 48 is always sufficient to finish a started press cycle if, at any time during the press cycle, the grid power supply should fail, so that all drives can be moved in an orderly manner and synchronously to a safe position and collisions can be avoided. The minimizing energy stored in the fly-wheel storage device 48 is preferably at least large enough for performing a complete press cycle. Actually, it is preferably somewhat higher, so that also after completion of a press cycle, information technical equipment such as a computer etc. can still be energized with a sufficient amount of energy.

A press installation with an energy management system comprises a fly-wheel energy storage device which, on one hand, has sufficient capacity for taking up the energy released during an emergency shut down and, on the other hand, stores at any time sufficient energy to permit an orderly completion of a press-cycle should the grid power supply fail. A central control unit monitors the operation of all servo-drive arrangements connected to a DC voltage intermediate circuit and also the fly-wheel storage device. Buffering of the electric energy from the DC voltage intermediate circuit can be achieved with good efficiency. Aging as it occurs with condensers is no concern for the fly-wheel energy storage devices. They achieve furthermore, a high energy density and a reaction speed in the range of milliseconds, and the number of charging and discharging cycles is unlimited. The fly-wheel storage device can further be modularized. Capacity increases can easily be achieved by parallel arrangements of fly-wheel storage devices. In any case, they have a long service life. The storage device also can be overcharged for short periods of, for example, 60 seconds. Its normal power storage capacity can be exceeded by up to 160% which may be utilized, for example, during an emergency shut down. If the fly-wheel storage device is overcharged, its energy may be fed back to the power grid if the converter provided for the supply of power to the DC voltage intermediate circuit 34 is a correspondingly controllable converter.

As described, the fly-wheel storage device 48 can be controlled via the determination of the energy balance of the individual drives. But, it is also possible to operate the fly-wheel storage device on the basis of the voltage measured in the DC voltage intermediate circuit 34. When this voltage increases energy is fed back from the DC voltage intermediate circuit 34 to the fly-wheel storage device 48 that is the fly-wheel storage device acts as a load. If the voltage in the DC voltage intermediate circuit drops, the control unit provides for energy transfer from the fly-wheel storage device 48 to the DC voltage intermediate circuit 34. Load peaks within a press installation 1 are therefore uncoupled from the power grid 46.

In a preferred embodiment, the control unit controls the converter arrangement, which is also called the "supply unit" and determines whether energy should be supplied to the DC voltage intermediate circuit, also called the DC bus, or energy should be fed back therefrom to the fly-wheel storage device. Predetermined power limits are taken into consideration in the process. The power limits can be determined dynamically. The control unit can, furthermore, monitor the rotational speed of the fly-wheel of the fly-wheel storage device and the voltage in the DC voltage intermediate circuit. The uptake of energy from the grid into the DC lines and the back feeding of energy into the grid can be controlled based on the following values:

upper limit of the fly-wheel speed of the storage device;
lower limit of the fly-wheel speed of the storage device;
desired value of the fly-wheel speed of the storage device;
actual value of the fly-wheel speed of the storage device;
desired value of the voltage of the DC intermediate circuit; and,
actual value of the voltage of the DC intermediate circuit.

The control occurs preferably with a view to minimizing the grid load peaks that is providing for a uniform grid loading. For activating the fly-wheel storage device, the drop and increase of the intermediate circuit voltage can be monitored and utilized as the voltage is the result of the difference between energy consumption and energy delivery from the power grid. If limits are set for the uptake of energy from the grid and feeding back of energy into the grid, there remain load peak or feed back peak differentials which are accommodated by the fly-wheel storage device.

When the intermediate circuit voltage drops, the braking procedure for the fly-wheels is initiated. The fly-wheel slowed down until the intermediate circuit voltage has reached the original value. When the intermediate circuit voltage rises, the acceleration procedure for the fly-wheel is initiated. The fly-wheel is accelerated until the intermediate circuit voltage has reached the original design value.

The power limits for feeding energy into the power grid are preferably set in such a way that long term speed of the fly-wheel, averaged over several press strokes remains constant.

With the dynamic adjustability of the power limits for the feeding energy back into the grid or taking it out of the grid, the amount of the uptake and the feedback can be influenced. The limits for the feedback and the uptake are different parameters and dynamically controllable from without. By changing the power limits of the supply unit, the point at which the energy supply support by the fly-wheel energy storage device is activated can be varied. By changing the feedback power limits of the supply unit, the point at which energy is fed back into the fly-wheel storage device can be varied.

With regard to the fly-wheel speed, the following operation is possible: When the servo-press is switched on, first the fly-wheel of the fly-wheel storage device is accelerated to the design-speed which is, for example, about ⅔ of the maximum speed. Upon reaching the desired speed, the fly-wheel storage device is ready to supply energy with dropping speed or to take up energy by acceleration of the fly-wheel from the desired speed to maximum speed. In order to achieve an as uniform grid load as possible, the power limits are reduced to such a degree that the load peaks are accommodated as much as possible by the fly-wheel storage device up to maximum fly-wheel speed. The fly-wheel speed varies between the maximum speed and a minimum speed close to zero.

The energy profile, that is energy requirements over time, of a servo-press depends on:

the deformation energy;

the movement profile; and, the number of cycles per minute.

Therefore, an optimal determination of the power limits for the manufacture of one part is not necessarily optimal for the manufacture of another part. Therefore, the power limits of the supply unit may be determined iteratively based on a base setting. The power limits are reduced during initial operation to such an extent and until the fly-wheel storage device reaches driving operation the upper and the lower limit speeds. At the same time it can be monitored whether the fly-wheel reaches again the desired speed within a press cycle.

The data determined for a particular part or workpiece, particularly, the power limits for feeding the DC lines from the grid and for the feeding of energy from the DC lines back into the grid can be recorded specifically for a particular workpiece in a workpiece data storage device. Later this data can be retrieved, so that it is not necessary to again determine the particular operating values for that workpiece.

During a power grid failure, all servo-drives are shut down in a controlled manner. The kinetic energy of the moving masses is supplied by generator operation of the servo-motors to the DC voltage intermediate circuit 34 and finally transferred to the fly-wheel storage device 48. With a controlled slow-down or shut down, consequently, the synchronization of all the servo-motors and, as a result, particularly the synchronization between the part transport and the plunger movement is maintained. The plungers can be moved to a safe rest position in which they can, for example, be locked. Data can be stored in an orderly way. Data processing units can further be operated with the energy available from the fly-wheel storage device. A destruction of, or damage to, the converter and drive electronics by an uncontrolled increases in the intermediate circuit voltage is effectively avoided. Also, a de-synchronization of individual drives with chances of collision of parts of the press installation is avoided.

What is claimed is:

1. A press installation (1), particularly for forming large parts, comprising:

a number of presses (2, 3, 4) representing different press stages, each including a stationary press table (14-16), a plunger (5, 6, 7) movable relative to the press table (14-16) and a servo-drive (8-13) for operating the presses (2, 3, 4);

a parts transport arrangement (22), with workpiece engagement structures (23, 24) for moving workpieces into and out of the presses (2, 3, 4) and a servo-drive (20, 21) for operating the transport arrangement;

a DC voltage intermediate circuit (34) connected to a power supply grid (46) via an AC/DC converter (45) and to the servo-drives (8-13, 20, 21) via servo converters (28-33);

a fly-wheel storage device (48) including a motor (49) operatively connected to a fly-wheel (50), the motor (49) connected to the DC intermediate circuit (34) via a voltage converter (52) for supplying energy to the DC intermediate circuit (34) and for recapturing excess energy therefrom; and, a control arrangement (35) connected to the converters (45, 28-33, 52) for controlling the flow of power between the DC intermediate circuit (34) and the servo-drives (8-13, 20, 21), the fly-wheel storage device (48) and the power supply grid (46).

2. The press installation according to claim 1, wherein the control arrangement (35) is additionally connected to the DC voltage intermediate circuit (34) for monitoring the voltage therein.

3. The press installation according to claim 1, wherein the control arrangement (35) controls the servo-drives (8, 20) in accordance with the working procedures for the workpieces.

4. The press installation according to claim 1, wherein the control arrangement (35) controls the AC/DC converter (45) and the fly-wheel storage device (48) during operation of the press installation (1) in such a way that the power supply from the power grid (46) is maintained within predetermined limits.

5. The press installation according to claim 4, wherein the control arrangement (35) controls the AC/DC converter (45) and maintains limits for the supply of power from the grid (46) and also for the feedback of power into the power supply grid (46).

6. The press installation according to claim 5, wherein the power limits are so selected that the utilization of the fly-wheel storage device (48) is maximized.

7. The press installation according to claim 5, wherein the power limits are so selected that the speed curve for the fly-wheel (50) of the fly-wheel storage device (48) is the same in all subsequent press cycles.

8. The press installation according to claim 5, wherein power limits are so selected that the grid (46) load is minimized.

9. The press installation according to claim 1, wherein the control arrangement (35) controls the AC/DC converter (45) and the fly-wheel storage device (48) during the operation of the press installation (1) in such a way that the power supply from the power supply grid (46) remains constant.

10. The press installation according to claim 1, wherein each of the servo-converters (28-33, 52) is provided with a power sensing device (42, 43, 44, 51) which is connected to the control arrangement (35) for supplying to it a signal indicative of the amount of power actually converted by the servo-converters.

11. The press installation according to claim 10, wherein the control arrangement (35) integrates the power amounts processed by the servo-drives (28-33, 52) during a press cycle in order to determine the energy used by each servo-drive (28-33, 52) during each press cycle.

12. The press installation according to claim 11, wherein the control arrangement (35) determines the sum of the energy used by the servo-drives (28-33, 52) and controls the AC/DC power converter (45) such that it retrieves from the power supply grid (46) a corresponding amount of energy.

13. The press installation according to claim 1, wherein the control arrangement (35) controls the fly-wheel storage device (48) in such a way that during a stationary operation of the press installation (1) the energy stored therein at the beginning of a press cycle is the same as at the end of a press cycle.

14. The press installation according to claim 1, wherein the control arrangement (35) controls the fly-wheel storage device (48) in such a way, that, at any time during a press cycle sufficient storage capacity is available for accommodating energy feed back to the fly-wheel storage device during an emergency shut-down of the press installation (1).

15. The press installation according to claim 14, wherein the control arrangement (35) controls the fly-wheel storage device (48) in such a way that, during an emergency shut-down of the press installation (1), the control arrangement (35) can take up grid (46) energy in order to reduce the grid (46) load in a controlled manner from the operating value to zero.

16. A method of operating a press installation (1), particularly a large part press installation, comprising:

a number of presses (2, 3, 4) representing different press stages, each including a stationary press table (14-16), a plunger (5, 6, 7) movable relative to the press table (14-16) and a servo-drive (8-13) for operating the press (2,3 4);

a parts transport arrangement (22) with workpiece engagement structures (23, 24) for moving workpieces into and out of the presses (2, 3, 4) and a servo-drive (20, 21) for operating the transport arrangement;

a DC voltage intermediate circuit (34) connected to a power supply grid (46) via an AC/DC converter (45) and to the servo-drives via servo converters (28-33);

a fly-wheel storage device (48) connected to the DC intermediate circuit (34) via a storage converter (52) for supplying energy to the DC intermediate circuit (34) and for recapturing excess energy there from; and, a control arrangement (35) connected to the converter (45, 28-33, 52), said method comprising the steps of maintaining and controlling the flow of power between the DC intermediate circuit (34) and the servo-drives (8-13, 20, 21), the fly-wheel storage device (48) and the power supply grid (46) so as to limit variations in the power demands from the power supply grid.

17. The method according to claim 16, wherein the control arrangement (35) is connected to the DC voltage intermediate circuit (34) for monitoring the voltage therein.

18. The method according to claim 16, wherein the control arrangement (35) controls the converters (28, 32, 52) in accordance with the working procedures for the workpieces.

19. The method according to claim 16, wherein the control arrangement (35) controls the AC/DC converter (45) and the fly-wheel storage device (48) during operation of the press installation (1) in such a way that the power supply from the power grid (46) is maintained within predetermined limits.

20. The method according to claim 16, wherein the control arrangement (35) controls the AC/DC converter (45) and the fly-wheel storage device (48) during operation of the press installation (1) in such a way that the power supply from the power grid (46) remains constant.

21. The method according to claim 16, wherein each of the servo-converters (28-33, 52) is provided with a power sensing device (42, 43, 44, 51) which is connected to the control arrangement (35) so as to supply a signal to the control arrangement (35) indicative of the amount of power actually converted by the servo-converters.

22. The method according to claim 21, wherein the control arrangement (35) integrates the power amounts processed by the servo converters (28-33, 52) during a press cycle in order to determine the energy used by each servo converter (28-33, 52) during each press cycle.

23. The method according to claim 22, wherein the control arrangement (35) determines the sum of the energy used by the servo converters (28-33, 52) and controls the AC/DC power converter (45) such that it retrieves from the power supply grid (46) a corresponding amount of energy.

24. The method according to claim 16, wherein the control arrangement (35) controls the fly-wheel storage device (48) in such a way that during a stationary operation of the press installation (1) the energy stored therein at the beginning of a press cycle is the same as at the end of a press cycle.

25. The method according to claim 16, wherein the control arrangement (35) controls the fly-wheel storage device (48) in such a way, that, at any time during a press cycle sufficient storage capacity is available for accommodating energy feed back to the fly-wheel storage device during an emergency shut-down of the press installation (1).

26. The method according to claim 25, wherein the controls arrangement (35) controls the fly-wheel storage device (48) in such a way that, during an emergency shut-down of the press installation (1) the control arrangement (35) can take up grid (46) energy in order to reduce the grid (46) load in a controlled manner from the operating value to zero.

* * * * *